US007536301B2

(12) United States Patent
Jaklitsch et al.

(10) Patent No.: US 7,536,301 B2
(45) Date of Patent: May 19, 2009

(54) SYSTEM AND METHOD FOR IMPLEMENTING REAL-TIME ADAPTIVE THRESHOLD TRIGGERING IN ACOUSTIC DETECTION SYSTEMS

(75) Inventors: James Jaklitsch, Parkton, MD (US); Gary Hartman, Sykesville, MD (US); Jay Markey, York, PA (US); Niall B. McNelis, Timonium, MD (US)

(73) Assignee: AAI Corporation, Hunt Valley, MD (US)

( * ) Notice: Subject to any disclaimer, the term of this patent is extended or adjusted under 35 U.S.C. 154(b) by 699 days.

(21) Appl. No.: 11/025,920

(22) Filed: Jan. 3, 2005

(65) Prior Publication Data

US 2006/0149541 A1 Jul. 6, 2006

(51) Int. Cl.
*G10L 21/02* (2006.01)

(52) U.S. Cl. ..... 704/226; 704/228; 704/233; 704/500; 370/280; 370/276

(58) Field of Classification Search ..... 704/200.1, 704/226, 229, 270, 500–504; 381/94.1, 94.3, 381/13; 370/276, 201, 280; 701/1, 36
See application file for complete search history.

(56) References Cited

U.S. PATENT DOCUMENTS 3,341,810 A 9/1967 Wallen, Jr.
4,975,953 A * 12/1990 Kennedy et al. ..... 381/13
5,007,032 A 4/1991 Jensen
5,047,995 A 9/1991 Wells
5,117,401 A 5/1992 Feintuch
5,263,019 A 11/1993 Chu
5,455,868 A 10/1995 Sergent et al.
5,544,250 A * 8/1996 Urbanski ..... 381/94.3
5,632,003 A * 5/1997 Davidson et al. ..... 704/200.1
5,666,429 A * 9/1997 Urbanski ..... 381/94.1
5,673,289 A * 9/1997 Kim et al. ..... 704/229
5,703,835 A 12/1997 Sharkey et al.
5,831,936 A 11/1998 Zlotnick et al.
5,973,998 A 10/1999 Showen et al.
H1916 H 11/2000 Hollander
6,185,153 B1 2/2001 Hynes et al.
6,230,138 B1 * 5/2001 Everhart ..... 704/275
6,240,051 B1 5/2001 Bunks (Continued)

OTHER PUBLICATIONS

Search Report for PCT/US05/47351.

(Continued)

*Primary Examiner*—Vijay B Chawan
(74) *Attorney, Agent, or Firm*—Venable LLP; Jeffri A. Kaminski

(57) ABSTRACT

A system and method to generate a trigger signal based on a real-time adaptive threshold. The system may include a microphone to receive an audio signal, a device to generate a trigger signal based on a real-time adaptive threshold coupled to the microphone to form an adaptive threshold and generate a trigger signal if a magnitude of the audio signal is greater than a magnitude of the adaptive threshold. The system may also include a waveform capture module coupled to the microphone to receive the audio signal and convert the audio signal into a series of waveform packets and a waveform analysis processor to extract characteristics from the waveform packets.

37 Claims, 5 Drawing Sheets

U.S. PATENT DOCUMENTS

| | | | | |
|---|---|---|---|---|
| 6,240,347 | B1 * | 5/2001 | Everhart et al. | 701/36 |
| 6,282,176 | B1 * | 8/2001 | Hemkumar | 370/276 |
| 6,308,150 | B1 * | 10/2001 | Neo et al. | 704/200.1 |
| 6,434,110 | B1 * | 8/2002 | Hemkumar | 370/201 |
| 6,552,963 | B2 | 4/2003 | Baranek et al. | |
| 6,914,854 | B1 * | 7/2005 | Heberley et al. | 367/119 |
| 6,931,307 | B2 * | 8/2005 | Everhart et al. | 701/1 |
| 6,961,698 | B1 * | 11/2005 | Gao et al. | 704/229 |
| 7,092,881 | B1 | 8/2006 | Aguilar et al. | |
| 2004/0093206 | A1 * | 5/2004 | Hardwick | 704/221 |
| 2004/0100868 | A1 | 5/2004 | Patterson, Jr. et al. | |
| 2006/0074646 | A1 * | 4/2006 | Alves et al. | 704/226 |

OTHER PUBLICATIONS

US 6,115,327, 09/2000, Hynes (withdrawn)

* cited by examiner

SYSTEM AND METHOD FOR IMPLEMENTING REAL-TIME ADAPTIVE THRESHOLD TRIGGERING IN ACOUSTIC DETECTION SYSTEMS

BACKGROUND OF THE INVENTION

1. Field of the Invention

The present invention relates generally to acoustic sensing systems, and more particularly to acoustic sensing systems for gunfire detection.

2. Related Art

Acoustic sensing systems for gunfire detection use multiple acoustic sensors to detect the supersonic shock cone from a ballistic projectile. Conventional solutions for detection of supersonic shock waves have been expanded, over the last several years, to include detection of acoustic characteristics from subsonic projectiles as well.

The performance of existing art acoustic gunfire detection systems is generally less than the level of performance desired in order to be truly effective in field environments. One of the principal drawbacks to conventional systems is their inability to deal with the high levels of acoustic interference that are often present in tactical environments. Such systems do not enable acoustic gunfire detection systems to deal effectively with background noise, and thereby achieve optimum detection sensitivity.

BRIEF SUMMARY OF THE INVENTION

Exemplary embodiments of the invention provide a system and method for implementing real-time adaptive threshold triggering. An exemplary embodiment of the invention may provide a device to generate a trigger signal based on a real-time adaptive threshold. The device may include a noise state estimator to monitor an audio signal, estimate a level of background noise in the audio signal, and output the estimate of the level of background noise. The device may also include a static offset generator coupled to the noise state estimator. The static offset generator may receive the estimate of the level of background noise, apply an offset from the estimate of the level of background noise to form a static threshold, and output the static threshold. The device may further include a dynamic offset generator to generate a dynamic offset from a post-trigger level of background noise and output the dynamic offset from the post-trigger level of background noise; circuitry coupled to the static offset generator and the dynamic offset generator to receive the static threshold and the dynamic offset from the post-trigger level of background noise, apply the dynamic offset from the post-trigger level of background noise to the static threshold to form an adaptive threshold, and output the adaptive threshold; and a comparator to compare the audio signal to the adaptive threshold and generate a trigger signal if a magnitude of the audio signal is greater than a magnitude of the adaptive threshold.

A further exemplary embodiment of the invention may provide a method for generating a trigger signal based on a real-time adaptive threshold. The method may include monitoring an audio signal, estimating a level of background noise in the audio signal, generating a static threshold by applying an offset from the estimate of the level of background noise, generating a dynamic offset from the a post-trigger level of background noise, generating an adaptive threshold by applying the dynamic offset to the static threshold, comparing a magnitude of the adaptive threshold to a magnitude of the audio signal, and generating a trigger signal if the magnitude of the audio signal is greater than the magnitude of the adaptive threshold.

Still a further exemplary embodiment of the present invention may provide a system for implementing real-time, adaptive threshold triggering. Such a system may include a microphone to receive an audio signal, a device to generate a trigger signal based on a real-time adaptive threshold coupled to the microphone to form an adaptive threshold and generate a trigger signal if a magnitude of the audio signal is greater than a magnitude of the adaptive threshold. The system may also include a waveform capture module coupled to the microphone to receive the audio signal and convert the audio signal into a series of waveform packets and a waveform analysis processor to extract characteristics from the waveform packets.

In yet a further exemplary embodiment of the invention, a vehicle may incorporate a system for implementing real-time, adaptive threshold triggering. Such a vehicle may be a combat vehicle.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
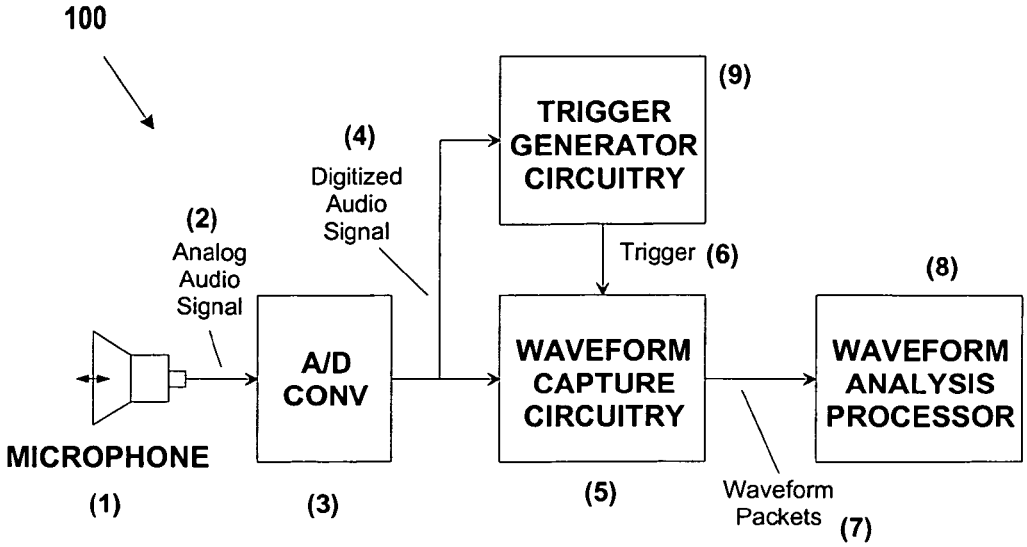
FIG. 1 depicts an exemplary embodiment of a system for implementing exemplary embodiments of the present invention.

FIG. 1 depicts an exemplary embodiment of a system 100 for implementing real-time adaptive threshold triggering.

FIG. 1 illustrates an exemplary embodiment of a single data-acquisition channel in an acoustic gunfire detection system. In such an embodiment, the acoustic characteristics of a passing projectile are sensed by a microphone 1, which produces an analog audio signal 2, for example. This audio signal may be digitized by an analog to digital (A/D) converter 3, resulting in a digitized audio signal 4. In an exemplary embodiment of the invention, the digital audio signal may be a continuous stream of numbers, representing the acoustic environment at the microphone 1.

This continuous data stream of the digitized audio signal 4 may be converted to a series of waveform packets 7 by waveform capture circuitry 5. The waveform packets may be discrete time-slices of the continuous data stream, suitable for subsequent processing by a waveform analysis processor 8, for example. The waveform analysis processor can analyze the waveform packets 7 to extract specific characteristics from the audio waveform. In an exemplary embodiment of the invention, this data may be analyzed with respect to signatures and timing, and is correlated to measurements obtained from other channels, in order to compute the location of gunfire origin (i.e., a shooter's position).

Trigger generator circuitry 9 may activate the waveform capture circuitry 5 by means of a trigger 6, for example. In an exemplary embodiment of the invention, a trigger may be generated whenever the magnitude of the digitized audio signal 4 crosses a defined threshold, indicating the probable presence of a feature of interest within the data stream. The waveform capture circuitry 5 may respond to the trigger 6 by capturing a discrete time-slice of the digitized audio signal 4, and forwarding the resulting waveform packet 7 to the waveform analysis processor 8 for further processing.

The threshold at which trigger generator circuitry 9 produces a trigger 6 may be critical to overall system performance. For example, if the threshold is too low, triggers can be continuously generated, and the waveform analysis processor will be flooded with waveform packets that contain nothing but background noise. This condition is likely to produce false reports of detected gunfire (i.e., false alarms). If, however, the threshold is set too high, system sensitivity can be reduced. Legitimate gunfire events may fail to trip the threshold, and thus go undetected. The problem is complicated by the fact that the level of background noise can be widely variable. In such an environment where the level of background noise is widely variable, it may be very difficult to set a static threshold that does not result in a significant compromise in system performance.

Figure 2:
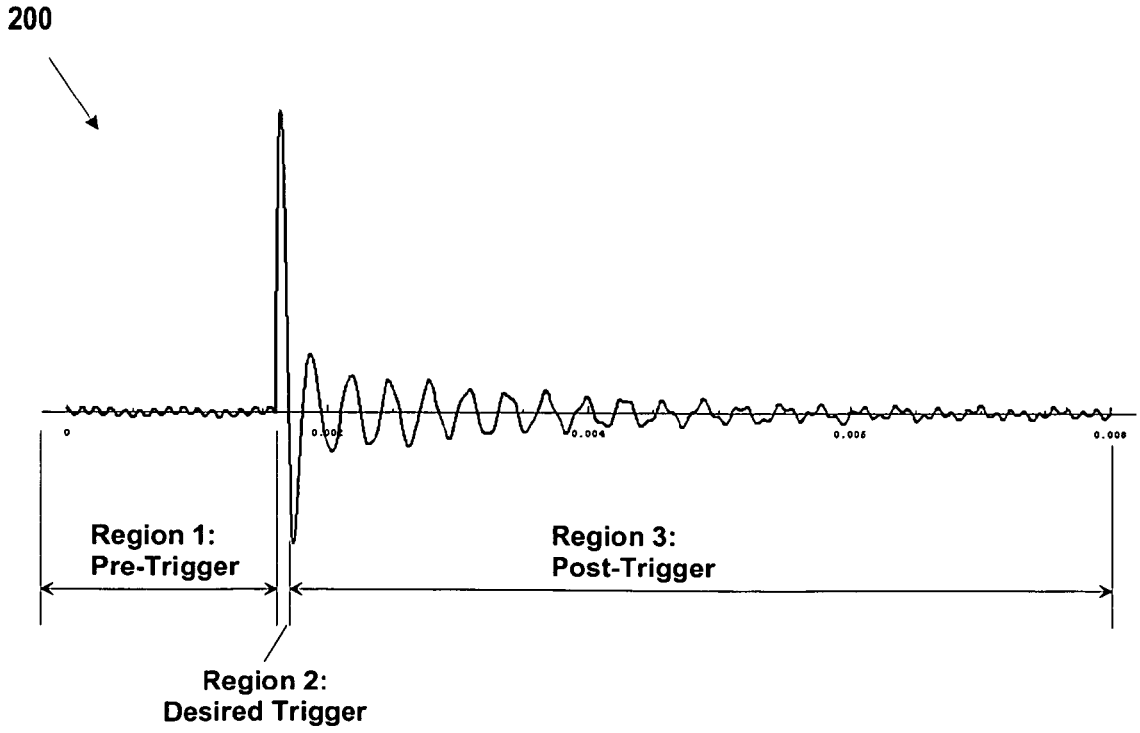
FIG. 2 depicts an exemplary embodiment of a graph illustrating the waveform characteristics of a digital audio signal.

FIG. 2 depicts an exemplary embodiment of a graph 200, which illustrates waveform characteristics of the digitized audio signal 4 for a passing bullet. As shown in FIG. 2, the desired trigger is the large spike shown in region 2. Prior to the occurrence of the trigger event (shown as Region 1: Pre-Trigger), there may be some arbitrary level of background noise. The background noise level may vary widely, but is likely to be quasi-static (e.g., have a slowly changing root mean square (RMS) value). Immediately following the desired trigger (Shown as Region 3: Post-Trigger), the noise level typically may increase dramatically, and may be characterized by ringing induced by the transient spike that constitutes the desired trigger. The ringing may be illustrated as an exponentially decaying sinusoid, starting out, for example, approximately 20 dB below the peak amplitude, and slowly decaying (tens of milliseconds) back to the quasi-static noise floor.

Figure 3:
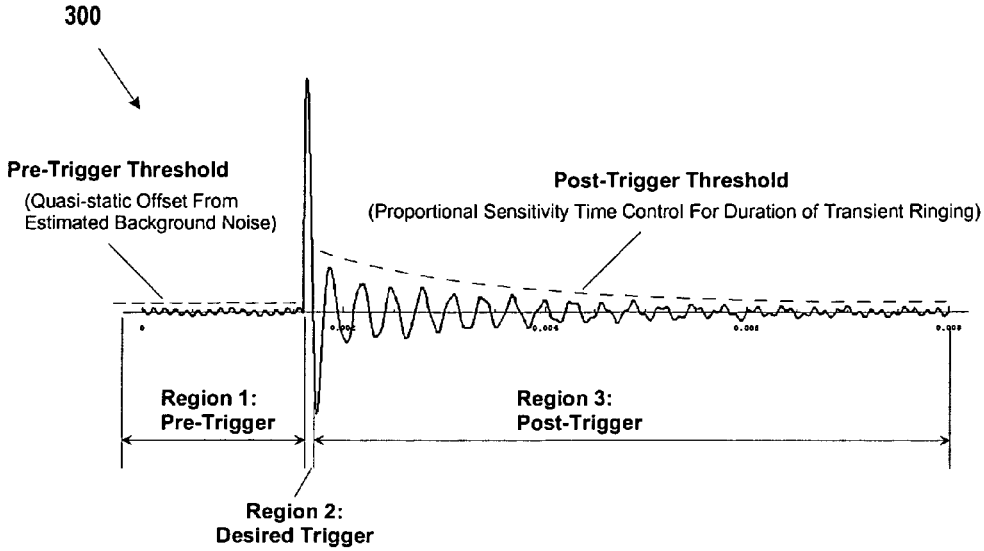
FIG. 3 depicts an exemplary embodiment of a graph illustrating adaptive threshold characteristics for optimum detection sensitivity according to the present invention.

FIG. 3 illustrates depicts an exemplary embodiment of a graph 300 illustrating the adaptive threshold characteristics needed to maintain optimum detection sensitivity without allowing false triggers. In general, a threshold may be set just above the level of background noise. In the Pre-Trigger Region (Region 1), this may be done by estimating the level (RMS value) of the background noise, and then applying a small offset (for example, a few dB) to establish a threshold. In the Post-Trigger Region (Region 3), the threshold may have real-time dynamics sufficient to follow the envelope of the exponentially decaying sinusoidal ringing. This may be accomplished by implementing a Proportional Sensitivity Time Control (PSTC) that follows the predicted envelope of the ringing waveform. In an exemplary embodiment of the invention, the PSTC may be a dynamic threshold desensitization that begins at a value proportional to the magnitude of the transient spike (for example, approximately −20 dB below peak amplitude), and decays with an appropriate time constant.

Figure 4:
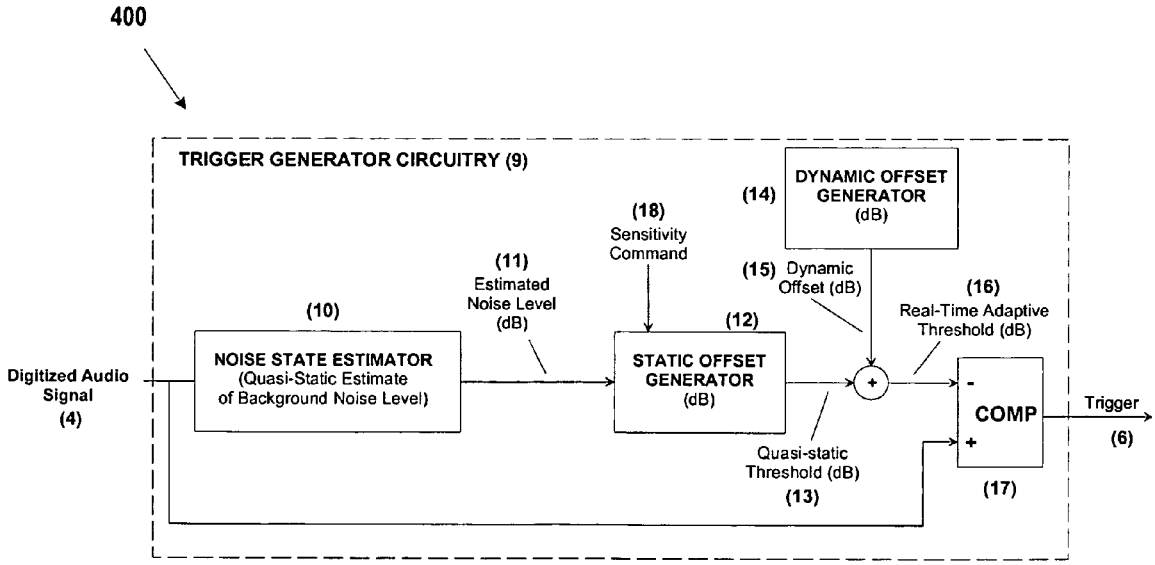
FIG. 4 depicts an exemplary embodiment of a device for implementing real-time adaptive threshold triggering according to the present invention.

FIG. 4 depicts an exemplary embodiment of a device 400 for implementing real-time adaptive threshold triggering. More specifically, FIG. 4 illustrates an exemplary embodiment of the various components and functions of the trigger generator circuitry 9. In such an embodiment, a noise state estimator 10 may develop a quasi-static estimate of the level of background noise, in decibel (dB) increments, for example, by monitoring the digitized audio signal 4. The estimated noise level 11 may be updated at a 1 Hz rate, and may capable of following changes in background noise level at a tracking rate of 1 dB per second. The estimated noise level 11 is, by definition, the threshold value at which a false alarm rate of approximately 1 trigger event per second will occur. A static offset generator 12 may apply a constant offset, in units of dB for example, from the estimated noise level 11. A sensitivity command 18, can specify the amount of offset, in units of dB, to be produced. The estimated noise level 11, with the offset applied by the static offset generator 12, is the quasi-static threshold 13, in units of dB, for the trigger 6.

A dynamic offset generator 14 may produce the dynamic offset signal 15, in units of dB. This signal may be referred to as the Proportional Sensitivity Time Control (PSTC) discussed in FIG. 3, above. The dynamic offset 15 may be summed with the quasi-static threshold 15 to form a composite real-time adaptive threshold 16 for the trigger comparator 17. A trigger 6 may be generated whenever the digitized audio signal 4 exceeds the real-time adaptive threshold at the comparator 17, for example.

The real-time adaptive threshold 16 may be constantly adjusting, in units of dB for example, to follow the quasi-static changes in background noise level, and to apply a dynamic PSTC after each trigger transient. In this manner, the system sensitivity is fully optimized, providing maximum permissible sensitivity in any given noise environment, without allowing undue risk of false alarms.

Figure 5:
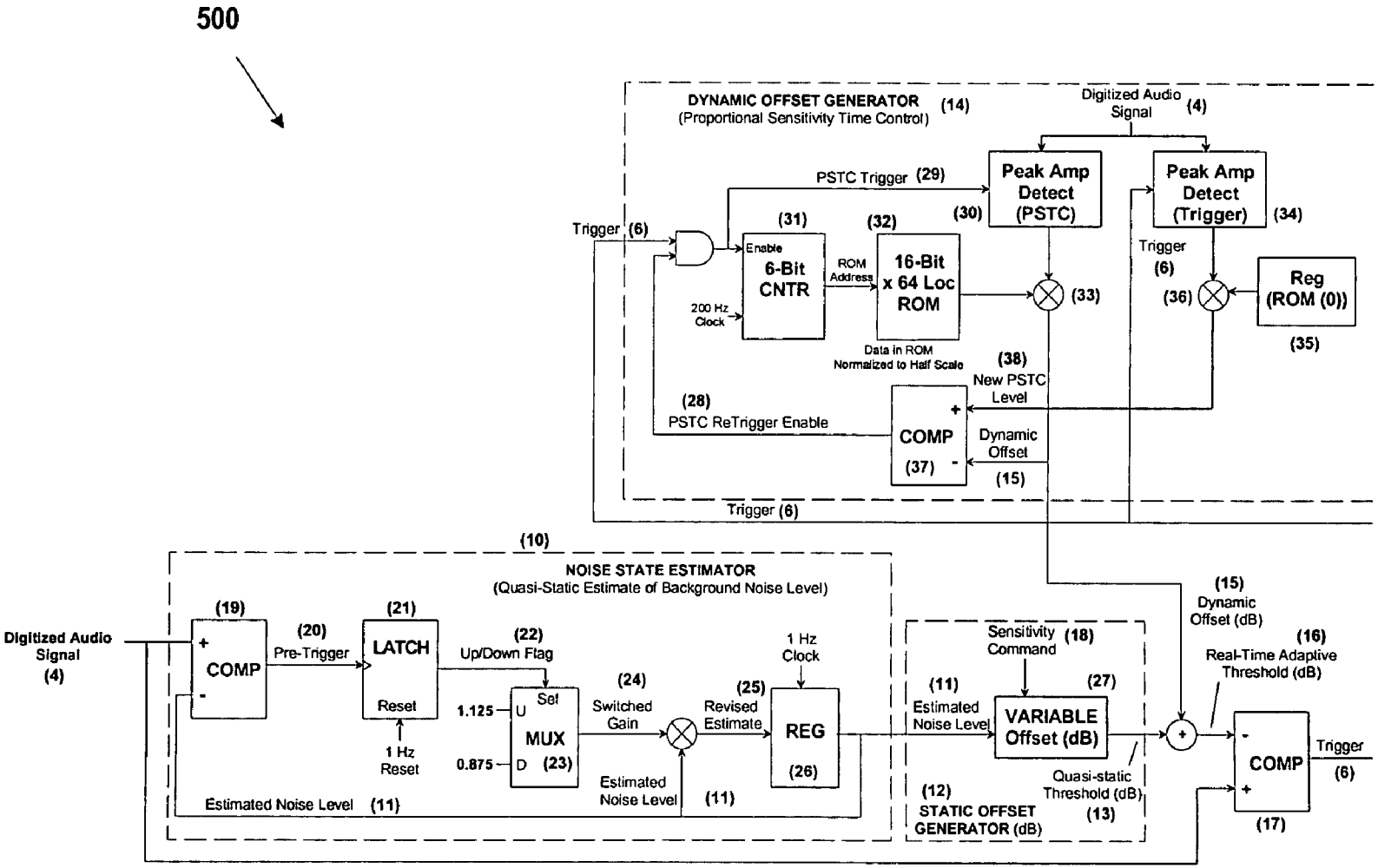
FIG. 5 depicts an exemplary embodiment a device for implementing real-time adaptive threshold triggering according to the present invention.

FIG. 5 illustrates detailed views of a device 500 including the exemplary components described above. As shown in FIG. 5, the noise state estimator 10 may be implemented in digital logic that accumulates estimated noise level 11 in a register 26. This process may begin by comparing the digitized audio signal 4 against the estimated noise level 11. If the digitized audio signal exceeds the current estimated noise level, a pre-trigger signal 20 may generated, setting a latch 21. In an exemplary embodiment of the invention, the latch may be reset each second (1 Hz), for example, and may stay reset unless a pre-trigger signal is detected.

The output of the latch may be an up/down flag 22 that may select either of two inputs of a multiplexer (MUX) 23, in order to implement a switched gain 24. The switched may gain assume, for example, the "Up" value (1.125, or +1 dB) if no pre-trigger signal was detected in the preceding 1 second measurement interval, and the "Down" value (0.875, or −1 dB) if at least 1 pre-trigger signal was detected. The switched gain 24 may then multiply the estimated noise level 11 to form a revised estimate 25, which may be clocked into the register 26 at a 1 Hz Rate, for example.

Thus, the noise state estimator 10 may operate by measuring the digitized audio signal 4 against the estimated noise level 11 over a one second interval. If the digitized audio signal is greater than the estimated noise level at any time during the 1-second measurement interval, the revised estimate will be 1 dB higher. If however, the digitized audio signal remains below the estimated noise level for the entire 1-second measurement interval, the revised estimate will be 1 dB lower. In this manner, the estimated noise level may continuously increase or decrease in 1 dB increments, tracking changes in background noise level at slew rates of 1 dB/second.

The dynamic offset generator 14 may be implemented by storing, for example, Sensitivity Time Control (STC) data in a Read Only Memory (ROM) 32, and clocking through the ROM addresses with a 6-Bit Counter 31, at a 200 Hz clock rate. The counter 31 may be configured to count through all states whenever it is triggered, then hold at terminal count. In the hold state, the counter therefore addresses ROM location 63, which is programmed with zero offset. This state may be held until a trigger signal 6 is received, for example.

In an exemplary embodiment of the invention, when a trigger 6 occurs, and the PSTC ReTrigger Enable 28 is valid, a PSTC Trigger 29 may be accepted. The PSTC Trigger 29 may then reset the 6-Bit counter 31, and enable it to begin counting though the ROM 32 addresses. The PSTC trigger may simultaneously capture the peak amplitude of the trigger transient that occurred on the digitized audio signal 4, by latching this value into the peak amp detect (PSTC) register 30, for example. As the counter 31 clocks through the ROM 32 addresses, the stored data at each address may be multiplied 33 by the amplitude value captured in the peak amp detect (PSTC) register 30. This may scale the STC profile stored in the ROM 32 to be proportional to the peak amplitude stored in the peak amp detect (PSTC) register 30. The resulting Proportional STC (PSTC) profile is the dynamic offset 15 term.

Since a trigger 6 may occur at any time, it is possible that the counter 31 may already be part of the way through generating the PSTC profile from a previous trigger. A decision should be made, therefore, as to whether to restart the PSTC profile (i.e., Re-Trigger), or simply allow the already running PSTC profile to run to completion. In an exemplary embodiment of the invention, this decision may be made by a comparator 37, which may enable a Re-Trigger 28 if the New PSTC Level 38 is greater than the present value of dynamic offset 15. If the New PSTC Level is less than the current dynamic offset, the PSTC Re-Trigger may not be enabled, and the current PSTC profile may be allowed to run to completion. The New PSTC Level 38 may be determined by capturing the peak amplitude of the trigger in a register 34 and multiplying it 36 with a register 35 that contains the first value in the STC profile (i.e., the data in ROM 32 Location 0).

In an exemplary embodiment of the invention, the static offset generator 12 may be implemented as a variable offset 27, in decibels, from the estimated noise level 11. The output of the variable offset 27 may be the quasi-static threshold 13, in decibels, as noted above.

Figure 6:
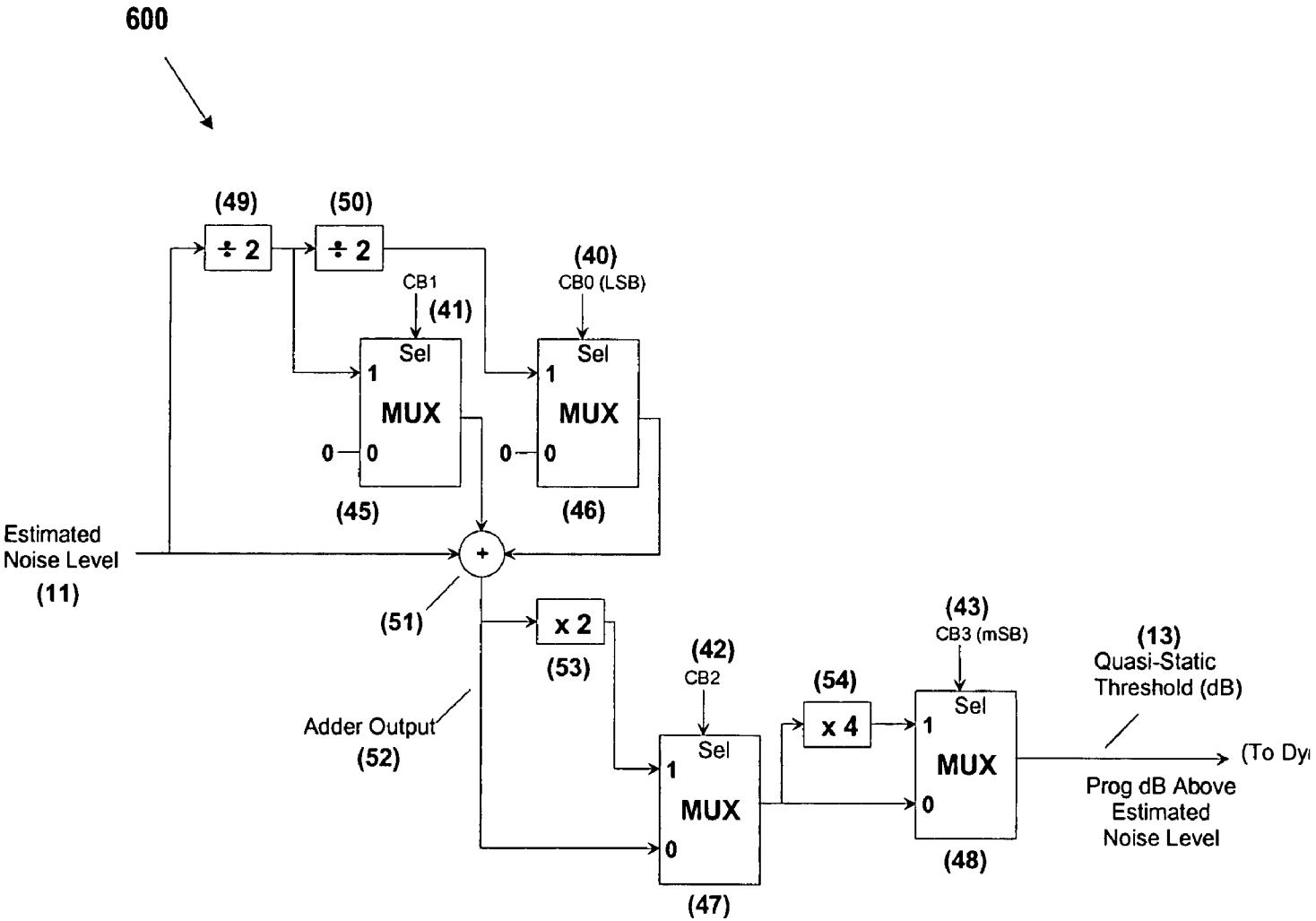
FIG. 6 depicts an exemplary embodiment a static offset generator according to the present invention.

FIG. 6 depicts an exemplary embodiment of a device 600 according to the present invention, which illustrates how the variable offset 27 may be implemented in fixed-point digital logic. The sensitivity command 18 may consist of four control bits: CB0 (LSB) 40, CB1 41, CB2 42, and CB3 (MSB) 43. Each of these bits may control one of the multiplexers 46, 45, 47, 48. In an exemplary embodiment of the invention, each multiplexer can select between a low-side input of zero, or a high-side input.

The estimated noise level 11 may divided by two 49 before it is routed to the high-side input of the half-scale multiplexer 45, and again by two 50 before being routed to the high-side input of the quarter-scale multiplexer 46. The adder 51 may then sum the estimated noise level 11 with the outputs of the half-scale multiplexer 45 and the quarter-scale multiplexer 46 to produce the adder output 52. Depending upon the state of control Bits CB1 41 and CB0 40, the adder output can thus assume the values 1.0, 1.25, 1.5, or 1.75 times the Estimated Noise Level 11. In such an embodiment, this equates to an offset of 0 dB, +1.94 dB, +3.52 dB, or +4.86 dB over the Estimated Noise Level.

In an exemplary embodiment of the invention, the adder output 52 may drive the low-side input of the double-scale Multiplexer 47, and twice this value 53 may drive the high side input. The output of the double-scale multiplexer 47 may drive the low-side input of the quad-scale multiplexer, and four times 54 the output drives the high-side input. Depending upon the state of control bits CB2 42 and CB3 43, the quasi-static threshold can thus assume the values 1, 2, 4, or 8 times the adder output 52.

The combined effect of the four control bits (CB3, CB2, CB1, and CB0) is to enable the quasi-static threshold 13 to be offset from the estimated noise level 11 by between 0 dB and 23 dB, in increments of approximately 1.5 dB. Table 1 below shows the offset, in dB, resulting from each possible state of the four control bits.

TABLE 1

FIXED-POINT LOGIC IMPLEMENTATION OF STATIC OFFSET (Offset from Estimated Noise Level vs Control Word)

| CB3 | CB2 | CB1 | CB0 | GAIN | Offset (dB) |
|---|---|---|---|---|---|
| 0 | 0 | 0 | 0 | 1.00 | +0 |
| 0 | 0 | 0 | 1 | 1.25 | +1.94 |
| 0 | 0 | 1 | 0 | 1.50 | +3.52 |
| 0 | 0 | 1 | 1 | 1.75 | +4.86 |
| 0 | 1 | 0 | 0 | 2.00 | +6.02 |
| 0 | 1 | 0 | 1 | 2.50 | +7.96 |
| 0 | 1 | 1 | 0 | 3.00 | +9.54 |
| 0 | 1 | 1 | 1 | 3.50 | +10.9 |
| 1 | 0 | 0 | 0 | 4.00 | +12.0 |
| 1 | 0 | 0 | 1 | 5.00 | +14.0 |
| 1 | 0 | 1 | 0 | 6.00 | +15.6 |
| 1 | 0 | 1 | 1 | 7.00 | +16.9 |
| 1 | 1 | 0 | 0 | 8.00 | +18.0 |
| 1 | 1 | 0 | 1 | 10.0 | +20.0 |
| 1 | 1 | 1 | 0 | 12.0 | +21.6 |
| 1 | 1 | 1 | 1 | 14.0 | +22.9 |

Figure 7:
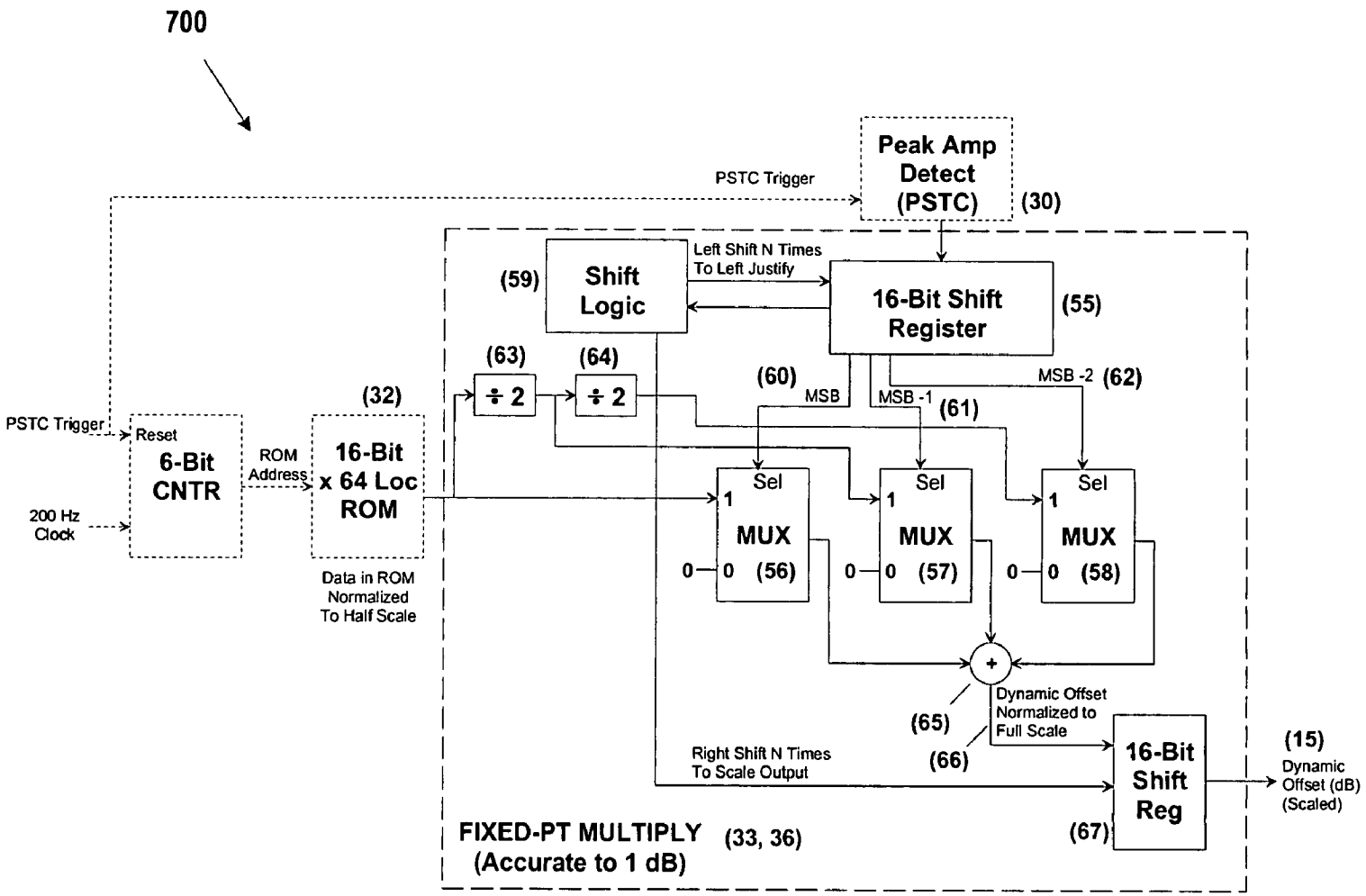
FIG. 7 depicts an exemplary embodiment a multiplier according to the present invention.

FIG. 7 illustrates an exemplary embodiment of a device 700 for implementing the multipliers 33, 36 (as shown in FIG. 5). This digital logic implementation may be capable of multiplying two 16-bit fixed-point numbers, and producing an answer accurate to within 1 dB.

In an exemplary embodiment of the invention, the value in the peak amplitude detect register 30 may be loaded into a 16-bit shift register 55 shift logic 59 clocks the shift register 55 to left shift the amplitude data until the MSB 60 is set (This left justifies the data). The number of shifts, N, required to left justify the amplitude data may be stored for later processing.

When the amplitude data is left justified, the three most significant bits (MSB 60, MSB-1 61, and MSB-2 62), each control one of the multiplexers 56, 57, 58. Each multiplexer can select between a low-side input of zero, or a high-side input.

In such an embodiment, the 16-Bit value in the ROM 32 may drive the high-side input of the unity multiplexer 56. This same data, divided by two 63, may drive the high-side input of the half-scale Multiplexer 57 and, when divided by two again 64, may drive the high-side input of the quarter-scale multiplexer 58.

The adder 65 may then sum the outputs of the unity multiplexer 56, half-scale multiplexer 57 and the quarter-scale multiplexer 58, to produce the adder output 66.

Depending upon the state of the shift register's three MSBs 60, 61, 62, the adder output can thus assume the values 0, 0.25, 0.5, 0.75, 1.0, 1.25, 1.5, or 1.75 times the 16-Bit value in the ROM 32. This resolution is sufficient to ensure accuracy to 1 part in 8 (1 dB). However, in an exemplary embodiment of the invention, the adder output 66 may be normalized to full scale, and may be right-justified to properly scale the answer. The shift register 67, and shift control logic 59 right-justify the answer by right shifting by N (i.e., the same number of times the original amplitude data was left shifted).

This process may produce a dynamic offset 15 that is proportional to the product of the data in the peak amp detect register 30 and the values stored in ROM 32, accurate to 1 dB.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A device, comprising;

a noise state estimator to monitor an audio signal, estimate a level of background noise in the audio signal, and output the estimate of the level of background noise;

a static offset generator coupled to said noise state estimator to receive the estimate of the level of background noise, apply an offset from the estimate of the level of background noise to form a static threshold, and output the static threshold;

a dynamic offset generator to generate a dynamic offset from a post-trigger level of background noise and output the dynamic offset from the post-trigger level of background noise;

circuitry coupled to said static offset generator and said dynamic offset generator to receive the static threshold and the dynamic offset from the post-trigger level of background noise, add the dynamic offset from the post-trigger level of background noise to the static threshold to form an adaptive threshold, and output the adaptive threshold; and an audio signal/adaptive threshold (AS/AT) comparator to compare the audio signal to the adaptive threshold and generate a trigger signal if a magnitude of the audio signal is greater than a magnitude of the adaptive threshold.

2. The device according to claim 1, wherein the estimate of the level of background noise represents a quasi-static, pre-trigger background noise level.

3. The device according to claim 2, wherein the offset from the estimate of the level of background noise is between 0.001 and 5 decibels.

4. The device according to claim 1, wherein the post-trigger level of background noise represents an exponentially decaying sinusoidal waveform.

5. The device according to claim 4, wherein the dynamic offset models the exponentially decaying sinusoidal waveform.

6. The device according to claim 1, wherein the audio signal is a digital audio signal.

7. The device according to claim 1, wherein said noise state estimator comprises:

a register to store a value representing the estimate of the level of background noise;

an audio signal/estimated noise level (AS/ENL) comparator coupled to said register to compare the audio signal to the estimate of the background noise level and generate a pre-trigger signal if the audio signal is greater than the estimate of the background noise level; a latch coupled to said AS/ENL comparator to output an up/down flag based on the pre-trigger signal; a multiplexer coupled to said latch to receive the up/down flag and output a multiplier based on the up/down flag; and circuitry to multiply the multiplier to the estimate of the level of background noise level and output a revised estimate of the level of background noise to said register.

8. The device according to claim 7, wherein said latch resets every second.

9. The device according to claim 8, wherein said latch stays reset until a pre-trigger signal is generated.

10. The device according to claim 7, wherein said multiplexer outputs a multiplier of 1.125 when the up/down flag is up.

11. The device according to claim 7, wherein said multiplexer outputs a multiplier of 0.0875 when the up/down flag is down.

12. The device according to claim 1, wherein said dynamic offset generator comprises:

a Read Only Memory (ROM) having a plurality of memory locations and an output, wherein each memory location is configurable to store a value representing an instance of an exponentially decaying sinusoidal waveform and the output is configurable to output one of the values;

a counter coupled to said ROM to clock through the plurality of memory locations;

a first register to store a value representing a peak amplitude of the audio signal when the trigger signal is generated; and circuitry coupled to said ROM and said first register to multiply one of the values to the value representing a peak amplitude of the audio signal and output the dynamic offset.

13. The device according to claim 12, wherein said dynamic offset generator further comprises:

a second register to store a value representing a peak amplitude of the audio signal when a second trigger signal is generated;

a third register to store one of the values representing an instance of an exponentially decaying sinusoidal waveform;

circuitry coupled to said second register and said third register to multiply the value representing a peak amplitude of the audio signal when the second trigger signal is generated to the value stored in the third register and output an updated dynamic offset; and a DO/UDO comparator to compare the dynamic offset with the updated dynamic offset and enable a re-trigger if the updated dynamic offset is greater than the dynamic offset.

14. The device according to claim 13, wherein the value stored in said third register is approximately 20 decibels less than the peak amplitude when the trigger is generated.

15. The device according to claim 13, wherein said ROM has X locations labeled zero to X−1 and the value stored in said third register is the same as the value stored in the zero location.

16. The device according to claim 1, wherein said static offset generator is implemented as a variable offset generator.

17. The device according to claim 16, wherein said static offset generator comprises: circuitry to enable the static threshold to be offset from the estimate of the level of background noise by between 0.0 and 23 decibels.

18. A method, comprising:

monitoring an audio signal;

estimating a level of background noise in the audio signal;

generating a static threshold by applying an offset from the estimate of the level of background noise;

generating a dynamic offset from a post-trigger level of background noise;

generating an adaptive threshold by adding the dynamic offset to the static threshold;

comparing a magnitude of the adaptive threshold to a magnitude of the audio signal; and generating a trigger signal if the magnitude of the audio signal is greater than the magnitude of the adaptive threshold.

19. The method according to claim 18, wherein the estimate of the level of background noise represents a quasi-static, pre-trigger background noise level.

20. The method according to claim 19, wherein the offset from the estimate of the level of background noise is between 0.001 and 5 decibels.

21. The method according to claim 18, wherein the post-trigger level of background noise represents an exponentially decaying sinusoidal waveform.

22. The method according to claim 21, wherein the dynamic offset models the exponentially decaying sinusoidal waveform.

23. The method according to claim 18, wherein the audio signal is a digital audio signal.

24. The method according to claim 18, wherein said generating a static threshold further comprising:

storing a value representing the estimated level of background noise in a register;

comparing the audio signal to the estimated level of background noise;

generating a pre-trigger signal if the audio signal is greater than the estimated level of background noise;

setting an up/down flag based on the pre-trigger signal;

outputting a multiplier based on the up/down flag;

multiplying the multiplier to the estimated level of background noise; and outputting a revised estimate of the estimated level of background noise to the register.

25. The method according to claim 24, further comprising: resetting the up/down flag once per second.

26. The method according to claim 25, wherein the up/down flag remains reset until a pre-trigger signal is generated.

27. The method according to claim 24, wherein a multiplier of 1.125 is output when the up/down flag is up.

28. The method according to claim 24, wherein a multiplier of 0.0875 is output when the up/down flag is down.

29. The method according to claim 18, said generating a dynamic offset comprising:

storing a value representing an instance of an exponentially decaying sinusoidal waveform in each one of a plurality of memory locations;

storing a value representing a peak amplitude of the audio signal in a first peak amplitude register when the trigger signal is generate; and generating the dynamic offset by multiplying each value representing an instance of an exponentially decaying sinusoidal waveform by the value representing a peak amplitude of the audio signal.

30. The method according to claim 29, said generating a dynamic offset further comprising:

storing a value representing a peak amplitude of the audio signal in a second peak register when a second trigger is generated;

storing one of the values representing an instance of an exponentially decaying sinusoidal waveform in a static register;

multiplying the value representing a peak amplitude of the audio signal when a second trigger is generated by the value stored in the static register to produce an updated dynamic offset;

comparing the dynamic offset to the updated dynamic offset; and generating a re-trigger signal if the updated dynamic offset is greater than the dynamic offset.

31. The method according to claim 29, wherein the value stored in said first peak amplitude register is approximately 20 decibels less than the peak amplitude when the trigger is generated.

32. The method according to claim 29, wherein said plurality of memory locations comprises X memory locations labeled zero to X−1 and the value stored in said third register is the same as the value stored in the zero location.

33. The method according to claim 18, wherein said static threshold is an offset from the estimate of the level of background noise by between 0.0 and 23 decibels.

34. A system comprising: a microphone to receive an audio signal; a device according to claim 1 coupled to said microphone to form an adaptive threshold and generate a trigger signal if a magnitude of the audio signal is greater than a magnitude of the adaptive threshold a waveform capture module coupled to said microphone to receive the audio signal and convert the audio signal into a series of waveform packets; and a waveform analysis processor to extract characteristics from the waveform packets.

35. The system according to claim 34, further comprising: an analog to digital (A/D) converter coupled between said microphone and each of said device and said waveform capture module to convert an analog audio signal into a digital signal.

36. A vehicle comprising: a vehicle frame; and the system according to claim 34.

37. The vehicle according to claim 36, wherein the vehicle is a combat vehicle.

* * * * *